United States Patent [19]

Gundal

[11] 4,133,260

[45] Jan. 9, 1979

[54] SHUT HEIGHT ADJUSTMENT MECHANISM

[75] Inventor: Peter H. Gundal, Centerville, Mass.

[73] Assignee: Packaging Industries, Inc., Hyannis, Mass.

[21] Appl. No.: 732,666

[22] Filed: Oct. 15, 1976

[51] Int. Cl.[2] ..... B30B 1/16

[52] U.S. Cl. ..... 100/257; 74/110; 74/520; 100/272

[58] Field of Search ..... 74/571 L, 110, 520, 74/522; 425/451–456; 100/272, 257, 264; 72/451

[56] References Cited

U.S. PATENT DOCUMENTS

| | | | |
|---|---|---|---|
| 719,242 | 1/1903 | Martin | 100/257 |
| 986,809 | 3/1911 | Derbyshire et al. | 100/272 |
| 1,218,771 | 3/1917 | Hoeschen et al. | 74/110 |
| 1,727,698 | 9/1929 | Clouse | 72/451 X |
| 1,729,996 | 10/1929 | Carroll | 100/257 |
| 2,054,428 | 9/1936 | Klocke | 100/257 X |
| 3,647,335 | 3/1972 | Brown, Jr. | 425/143 |
| 3,926,033 | 12/1975 | Forichon | 100/272 X |

FOREIGN PATENT DOCUMENTS

| | | | |
|---|---|---|---|
| 948381 | 8/1956 | Fed. Rep. of Germany | 72/451 |

*Primary Examiner*—Irwin C. Cohen
*Attorney, Agent, or Firm*—Brumbaugh, Graves, Donohue & Raymond

[57] ABSTRACT

A linkage includes a pair of links pivotally connected together near adjacent ends. The opposite end of one of the links pivots about an axis, moving the opposite end of the other link along a linear path. The position of the axis is adjusted along a linear path substantially parallel to the linear path traced by the opposite end of the other link.

3 Claims, 4 Drawing Figures

SHUT HEIGHT ADJUSTMENT MECHANISM

BACKGROUND OF THE INVENTION

The present invention relates to shut height adjustment mechanisms, and, more particularly, to a new and improved mechanism for adjusting the shut height between two members which are reciprocally displaced relative to each other by toggle linkages.

In its simplest form, a toggle linkage consists of a pair of links pivotally joined at adjacent ends. The far end of one of the links is pivoted about a fixed point; while the far end of the other link is adapted for linear motion. In such toggle linkages a small force at the juncture of the two links produces a much larger force at the far end of the other link. Accordingly, toggle linkages are commonly used in presses and crushers.

In the packaging industry, each of a pair of forming or sealing dies is mounted to a respective press plate for relative movement with respect to the other die between an open position, facilitating accommodation therebetween of a formable or sealable material, and a closed position, facilitating forming or sealing of the material. Toggle linkages are connected to the press plates for controlling the movement of the dies. With the press plates in the closed position, the links comprising each toggle linkage are usually aligned linearly to maximize the force capable of being applied through the toggle linkage, the distance between the press plates being referred to in the industry as the shut height. Depending upon the particular material to be formed or sealed, the size and shape of the dies change from one sealing or forming operation to the next. Thus, there is a need to adjust the shut height so that different dies may be used interchangeably without adversely affecting the forming or sealing operation. Likewise, in laminating, trimming, and other operations wherein material engaging members or tools close on inserted material, ordinary variances within the tolerance to which the tools are machined require fine adjustment to assure a proper shut height.

SUMMARY OF THE INVENTION

It is an object of the present invention to provide a new and improved device for efficiently and simply adjusting the position of a fixed pivot for a toggle linkage. This object, as well as other objects which become apparent in the discussion that follows, are achieved, according to the present invention, by adjusting the position of the pivot along a linear path substantially parallel to a linear path traced by the opposite end of the toggle linkage.

More particularly, the invention relates to an apparatus which conventionally includes a base, a plate member displaceable relative to the base, and a toggle linkage for displacing the plate member toward and away from the base. The toggle linkage has a first link and a second link, the links being pivotally connected near adjacent ends in such a manner that they are capable of linear alignment when the plate is displaced to a terminal position with respect to the base. The other end of the first link is pivotable about a fixed pivot spacedly positioned from the base and extending transversely of the first link. The other end of the second link is pivotally connected to the plate member and movable along a linear path in response to pivoting of the first link about the fixed pivot.

In accordance with the improvement, a mechanism interposed between the base and the first link moves the fixed pivot in generally the direction of movement of the other end of the second link, thereby varying the distance between the base and the pivot and adjusting the terminal position of the plate member with respect to the base. Thus, the position of the pivot can be adjusted without changing the linear alignment of the links and thus without reducing the load transmitting capability of the toggle linkage.

In one embodiment, the adjusting mechanism includes a toggle bearing in the form of a plate on which the fixed pivot is mounted; a wedge (called a toggle wedge for the purpose of this description) interposed between the base and the toggle bearing and slideably engaging a stationary bearing surface on the base and a bearing surface on the toggle bearing; and a device for sliding the toggle wedge back and forth between the base and the toggle bearing along the bearing surfaces thereof. For example, the device may include a shaft threadably connected at one end to the toggle wedge, the opposite end of the shaft being attached to a handwheel adapted to rotate the shaft. An angular bearing surface on the toggle wedge slideably engages the bearing surface on the toggle bearing which is angled complementally with the angular bearing surface on the toggle wedge.

When a recess is provided in the base as a track for the toggle wedge, the toggle bearing may engage the sides of the recess to restrain movement of the toggle bearing in a direction substantially transverse the movement thereof by the toggle wedge. Furthermore, the toggle wedge can be locked in place, after it has been properly positioned in the recess.

If two toggle linkages coact to displace the plate member, the fixed pivot for each of the toggle linkages can be located on the toggle bearing. Locating both pivots on the same toggle bearing is advantageous because it permits the position of both pivots to be adjusted simultaneously and to the same extent, resulting in a quick yet accurate adjustment procedure.

BRIEF DESCRIPTION OF THE DRAWING

For a further understanding of the invention, reference may be had to the accompanying drawing, in which.

DETAILED DESCRIPTION OF AN EXEMPLARY EMBODIMENT

While the invention is applicable to linkages designed for various applications, it is especially suitable for toggle linkages employed in sealing or forming apparatus. Accordingly, the invention will be described with particular reference to a sealing or forming apparatus commonly used in the packaging industry.

Figure 1:
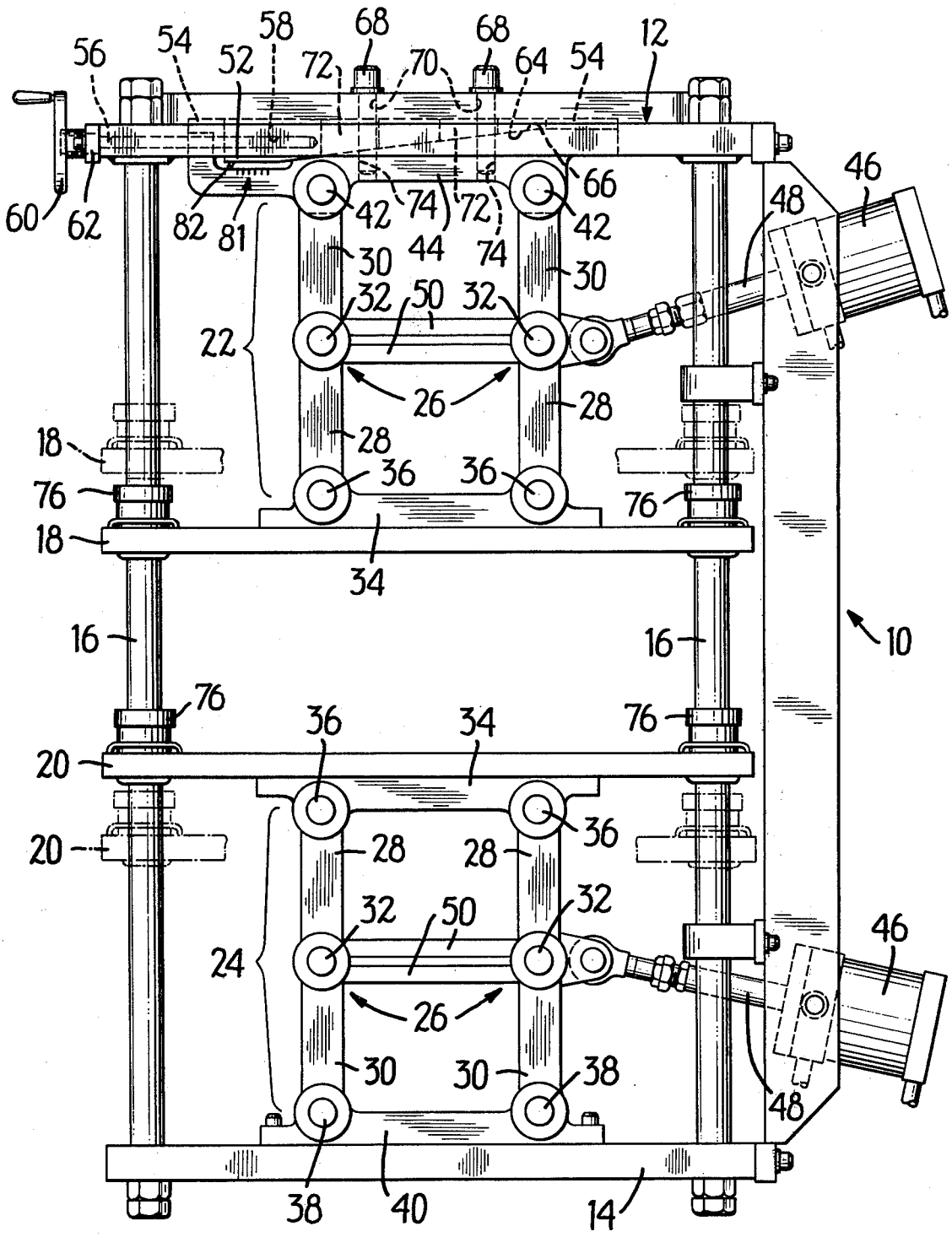
FIG. 1 is a front elevational view of one embodiment of a shut height adjustment mechanism according to the present invention, as employed in conjunction with a sealing or forming press apparatus.
Figure 2:
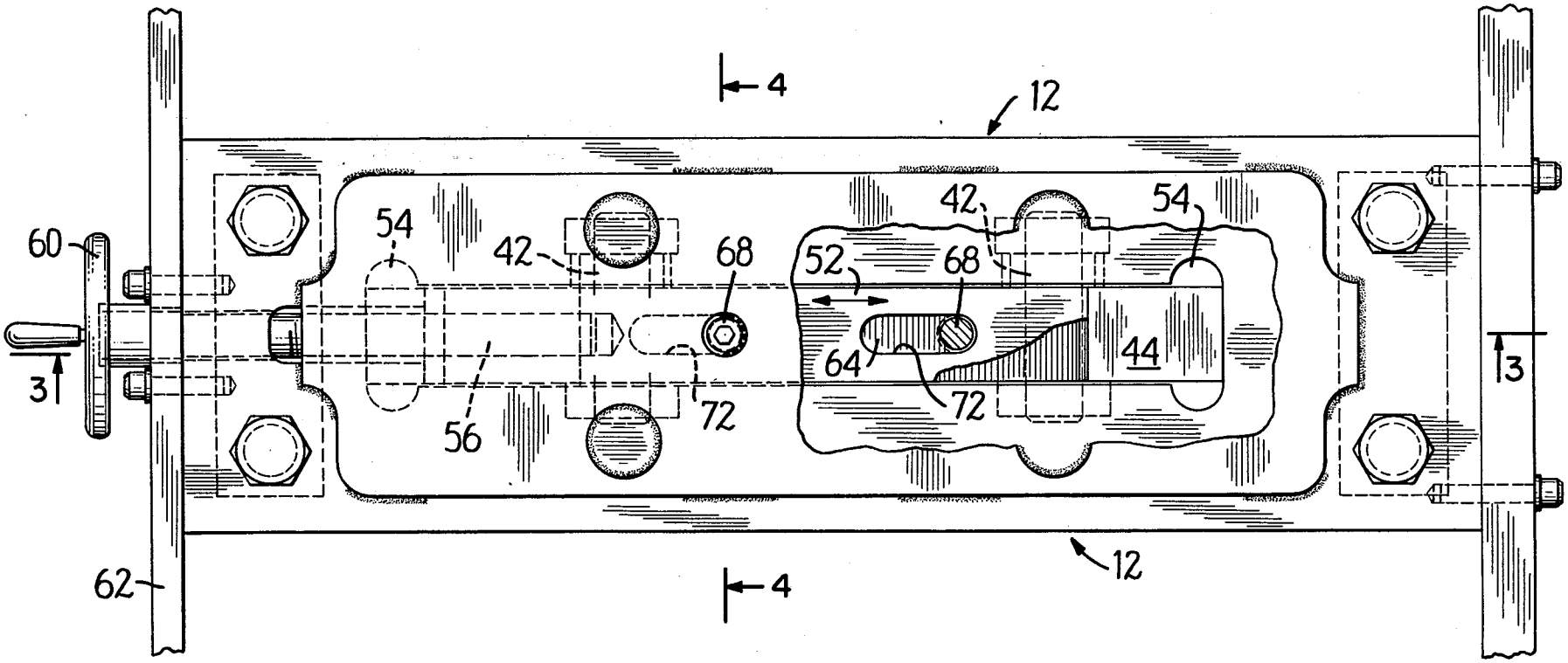
FIG. 2 is a top view, partly broken away, of the apparatus shown in FIG. 1.
Figure 3:
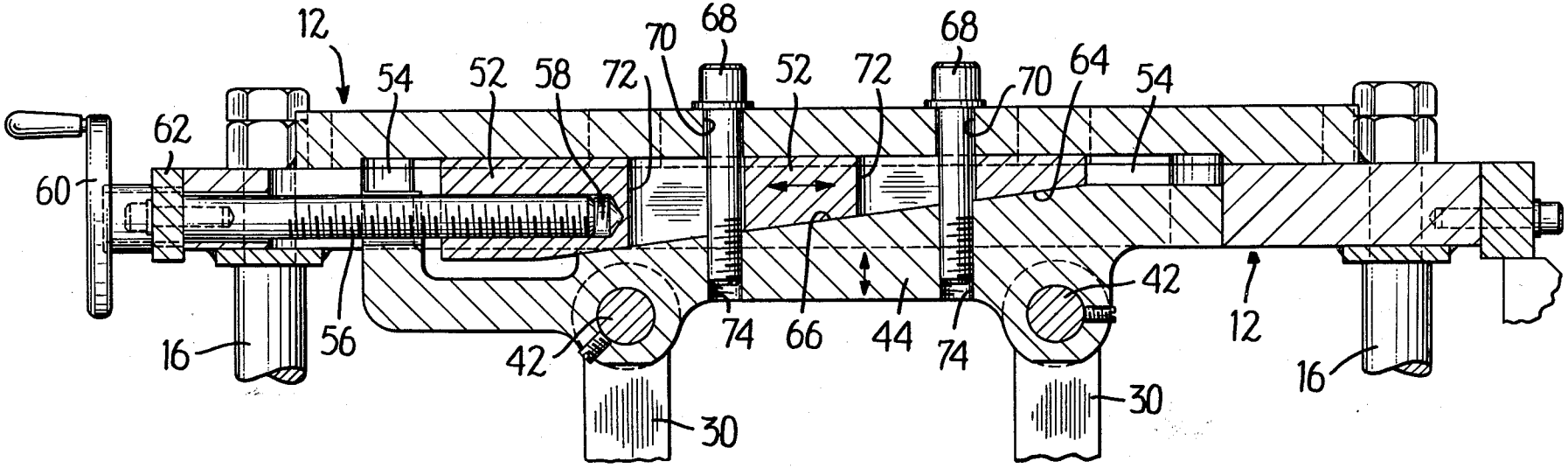
FIG. 3, is a cross-sectional view taken along line 3—3 in FIG. 2 and looking in the direction of the arrows.
Figure 4:
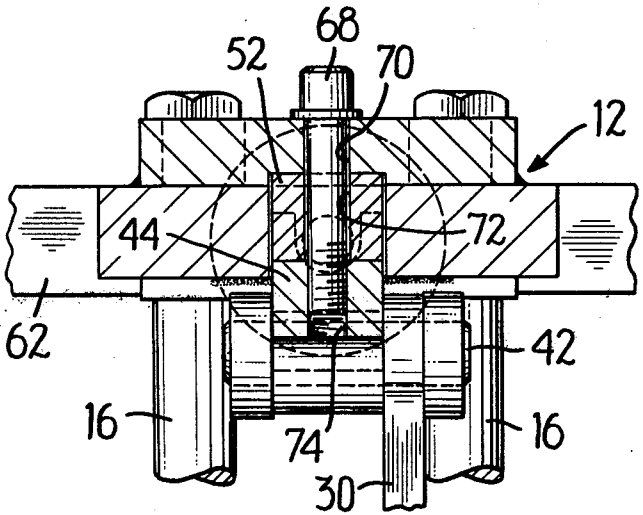
FIG. 4 is a cross-sectional view taken along line 4—4 of FIG. 2 and looking in the direction of the arrows.

Referring to FIG. 1, the apparatus 10 conventionally includes an upper base platen 12 and a lower base platen 14 which are fixedly positioned at opposite ends of two pairs of vertical cylindrical support members 16. Each of the support members 16 extends through an upper press plate or member 18 and a lower press plate or member 20, the press plates 18 and 20 being arranged horizontally. An upper toggle mechanism 22 and a lower toggle mechanism 24 slide the upper press plate 18 and the lower press plate 20, respectively, up and down along the support members 16 between an open position, indicated by the dashed lines, and a closed position, indicated by the solid lines. The adjacent surfaces of each of the press plates 18 and 20 are adapted to receive a sealing or forming die (not shown). In the open position, the spacing between the dies facilitates accommodation therebetween of a formable or sealable material, normally in the form of one or more webs. With the press plates 18 and 20 in the closed position, the dies coact to form or seal the material, the distance between the press plates 18 and 20 being known as the shut height.

Each of the toggle mechanisms 22 and 24 comprise a pair of toggle linkages 26, including a pair of vertically aligned links 28 and 30 pivotally connected together at a pivot 32. The other end of each link 28 of the toggle mechanisms 22 and 24 is pivotally connected to a toggle bearing plate 34 at a pivot 36, each of the toggle bearing plates 34 being fixedly attached to a respective press plate for movement therewith. While the other end of each link 30 of the toggle mechanism 24 pivots about a pivot 38 located on a stationary toggle bearing plate 40, which is fixedly attached to the lower base platen 14; the other end of each link 30 of the toggle mechanism 22 pivots about a pivot 42 located on an adjustable toggle bearing plate 44, which is displaceable generally in a vertical direction. Thus, the position of the toggle bearing plate 44 can be adjusted vertically relative to the upper base platen 12 to vary the shut height between the press plates 18 and 20.

Each of the toggle mechanisms 22 and 24 is provided with its own air cylinder 46 having a reciprocating piston 48 connected to one of the pivots 32. The motion imparted to the toggle linkage connected directly to the air cylinder is, in turn, imparted to the other toggle linkage by connecting rods 50.

Referring now to FIGS. 1–4, adjustment of the toggle bearing plate 44 is accomplished through the use of a toggle wedge 52 positioned between the toggle bearing plate 44 and the upper base platen 12. The toggle wedge 52 slides back and forth in a horizontal direction across a recess 54 formed in the upper base platen 12. Horizontal movement of the toggle wedge 52 is achieved by rotation of an externally threaded end of a shaft 56 within an internally threaded bore 58 in the toggle wedge 52. A handwheel 60 attached to the other end of the shaft 56, which is journalled in a stationary bracket 62, may be employed to rotate the shaft 56.

The toggle bearing plate 44 and the toggle wedge 52 have angular bearing surfaces 64 and 66, respectively, the angle of the bearing surface 64 matching the angle of the bearing surface 66. Each of a pair of socket-head cap screws 68 pass through a respective bore 70 in the upper base platen 12 and a respective oblong slot 72 in the toggle wedge 52, and is threadably received in a respective internally threaded bore 74 in the toggle bearing plate 44. When completely tightened, the cap screws 68 prevent inadvertent horizontal movement of the toggle wedge 52. Opposite ends of the toggle bearing plate 44 engage the sides of the recess 54 to restrain the toggle bearing plate 44 from movement in a horizontal direction.

To adjust the shut height between the presses 18 and 20, the cap screws 68 are loosened by an appropriate tool to free the toggle wedge 52 for horizontal movement with respect to the upper base platen 12 and the toggle bearing plate 44. The handwheel 60 is then turned to adjust the horizontal position of the toggle wedge 52. Due to the interfacing relationship of the angular bearing surfaces 64 and 66, adjustment of the horizontal position of the toggle wedge 52 results in vertical displacement of the toggle bearing plate 44. After the desired shut height adjustment has been made, the cap screws 68 are tightened to lock the toggle wedge 52 in place between the upper base platen 12 and the toggle bearing plate 44.

The movement of the bearing plate 44 which is the vertical shut height adjustment effected by positioning the wedge 52 can be indicated by inclusion of a scale 81, as shown in FIG. 1 or at another suitable visible location on the bearing plate 44 or the base platen 12, in relation to an indicator 82 appropriately positioned on the wedge. The scale 81 is proportioned to indicate not the horizontal movement of the wedge, but the vertical adjustment that the horizontal movement provides. This arrangement permits returning the shut height adjustment to a value previously found to be appropriate for a particular die when that die is used again.

Referring again to FIG. 1, oil retainers 76 can be connected to a lubricant source (not shown) to reduce friction developed as the press plates 18 and 20 slide along the support members 16. The pivots 32, 36, 38 and 42 may be provided with appropriate fittings (not shown) adapted to receive lubricant from the same source as the oil retainers 76.

It will be understood that the described embodiment is merely exemplary and that persons skilled in the art may make many variations and modifications without departing from the spirit and scope of the invention. For example, the angular bearing surface on the toggle bearing plate can be located instead on the upper base platen. All such modifications and variations are intended to be included within the scope of the invention as defined in the appended claims.

I claim:

1. In a press-type apparatus of the kind including first and second press members for supporting material engaging elements and wherein at least one of said press members is movable toward and away from the other member, an improved assembly including a base, said one press member being displaceable relative to said base when moving toward and away from said other member, a pair of toggle mechanisms coacting to displace said one press member toward and away from said base, each of said pair of said toggle mechanisms having a pair of links pivotally connected to each other near adjacent ends, the other end of one of said links of each pair being pivotable about a pivot on a bearing plate and the other end of the other link of each pair being pivotally connected to said one press member; and a shut height adjusting mechanism having means interposed between said base and said bearing plate for adjusting simultaneously and to the same extent the position with respect to said base of said bearing plate and each of said pivots thereon thereby adjusting the distance between said first and second press members and each of said pivots when said toggle mechanisms are operated to move said one press member toward said other press member, said adjusting mechanism including a wedge disposed in a recess formed in said base, each of a pair of opposite ends of said recess being engaged respectively by a corresponding one of a pair of projecting ends of said bearing plate, said wedge being located between said projecting ends of said bearing plate for movement in said recess between said pair of opposite ends thereof, whereby said bearing plate is retained against movement in the direction in which said wedge moves, and slidably engaging a stationary bearing surface on said base and a bearing surface on said bearing plate, said wedge having an angular bearing surface slidably engaging one of the bearing surfaces on said base and plate, said one of the bearing surfaces being angled complementally with said angular bearing surface of said wedge, and means for moving said wedge between said base and said bearing plate along the bearing surfaces thereof to adjust the bearing plate position relative to said base, whereby slight adjustment of the position to which said toggle mechanisms move said one press member is effected, said moving means including a shaft extending through an opening provided in one of said projecting ends of said bearing plate, said shaft extending to said wedge and terminating in a threaded end received in a threaded bore in said wedge, a handwheel at the other end of said shaft for turning said shaft thereby to slide said wedge, at least one bolt extending through said base and a slot in said wedge into threaded engagement within a bore in said bearing plate to compress said bearing plate fast against said wedge, and indicator means associated with said wedge and one of the base and bearing plate for visably indicating the amount of movement of the bearing plate upon sliding of said wedge.

2. The improvement of claim 1, wherein said bearing plate has said complementally angled surface in engagement with said angled bearing surface of said wedge.

3. The improvement of claim 1, wherein said at least one bolt is the sole means of securement for said bearing plate.

* * * * *